US005996553A

United States Patent [19]

Sanvido et al.

[11] Patent Number: 5,996,553

[45] Date of Patent: Dec. 7, 1999

[54] IDLE ACTUATOR SPEED CONTROL

[75] Inventors: David Jeffrey Sanvido, Ann Arbor; Joseph Mark Tolkacz, Novi; Mike Livshiz, Southfield; Sharanjit Singh, Farmington Hills, all of Mich.

[73] Assignee: General Motors Corporation, Detroit, Mich.

[21] Appl. No.: 09/024,140

[22] Filed: Feb. 17, 1998

[51] Int. Cl.[6] ..... F02D 9/00

[52] U.S. Cl. ..... 123/339.23

[58] Field of Search ..... 123/327, 339.14, 123/339.19, 339.21, 339.23

[56] References Cited

U.S. PATENT DOCUMENTS

| | | | |
|---|---|---|---|
| 4,337,742 | 7/1982 | Carlson et al. | 123/339 |
| 4,359,983 | 11/1982 | Carlson et al. | 123/339 |
| 4,901,000 | 2/1990 | Center et al. | 318/696 |
| 4,926,335 | 5/1990 | Flowers et al. | 123/431.05 |
| 5,429,088 | 7/1995 | Lang et al. | 123/339 |
| 5,638,788 | 6/1997 | Sanvido et al. | 123/339.2 |
| 5,740,045 | 4/1998 | Livhiz et al. | 123/431.03 |

*Primary Examiner*—Tony M. Argenbright
*Assistant Examiner*—Arnold Castro
*Attorney, Agent, or Firm*—Michael J. Bridges

[57] ABSTRACT

An internal combustion engine idle air control system including an idle air control actuator coupled to an idle air control valve for varying the position of the valve within an engine intake air passage for engine inlet air control under idle operating conditions adjusts the time rate of change in position of the idle air control valve in response to change in barometric pressure to account for change in air density passing across the valve and to account for change in torque load acting against the valve to precisely respond to torque load changes during idle operations without violating idle air control actuator stability margins.

10 Claims, 2 Drawing Sheets

IDLE ACTUATOR SPEED CONTROL

TECHNICAL FIELD

This invention relates to internal combustion engine intake air control and, more particularly, to control of the speed of actuation of an intake air control actuator.

BACKGROUND OF THE INVENTION

Internal combustion engine idle air control systems are known to precisely meter inlet air to cylinders of the engine in response to a difference between actual engine speed and a relatively low target engine speed. Change in engine torque load, for example resulting from change in accessory load, can perturb engine speed away from the target speed. A desirable engine idle air control system can reject typical changes in engine torque load to provide a stable engine speed that is pleasing to a vehicle operator.

Certain engine torque load changes can occur very rapidly. For example, substantially a step change in torque load can occur during certain transient maneuvers. To reject such rapid torque load changes, an engine idle air control system must be very responsive. Effort has been made in conventional systems to assess system response limits and then to push system response to the limits in response to a detected rapid torque load change to provide precise transient control of idle speed throughout the load change or, more specifically, to minimize the difference between the target and actual engine speeds throughout the transient maneuver.

It has been determined that the response limit of an engine idle air control system changes with change in barometric pressure. It has further been determined that the response requirements of the idle air control system change with change in barometric pressure. More specifically, in engine idle air control systems including an actuator coupled to a valve for metering air to the engine, the speed at which the actuator can be accurately driven is constrained by the load acting against the valve. The load acting against the valve increases with increasing barometric pressure. Conventional engine idle air control systems prescribe a fixed actuator speed over all barometric pressures. Accordingly, to provide for accurate actuator control, a worst case actuator speed is prescribed, which is a speed determined under high barometric pressure conditions. In such systems, untapped actuator performance capability remains under barometric pressure conditions below such high barometric pressure conditions.

To reject an engine load change, a corresponding change in engine torque is administered by changing an amount of fuel and air admitted to engine cylinders. The engine idle air control system provides for a desired time rate of change in intake air. The fuel control system reacts to the time rate of change in intake air to provide a corresponding time rate of change in injected fuel. As barometric pressure changes, the change in air density affects the amount of intake air passed to the engine for a given state of the idle air control system. As barometric pressure increases, for example, more air is admitted to the engine for a given state, and less change in position of a valve of the engine idle air control system is needed to provide for a desired time rate of change in intake air. Conventional systems prescribe, in response to a change in engine load, a change in position of the valve of the idle air control system at a single rate, which leads to, under varying barometric pressure conditions, significant variation in the time rate of change in air admitted to the engine. Substantially sub-optimized idle air control performance results, for example when responding to an engine load change under barometric pressure that is significantly different than a calibration pressure.

It would therefore be desirable to account for the effect of change in barometric pressure in engine idle air control, to maximize, when necessary, the responsiveness of the control, and to improve control accuracy.

SUMMARY OF THE INVENTION

The present invention provides a desirable engine idle air control system that is responsive to change in barometric pressure to provide accurate, responsive engine intake air control under idle operating conditions. More specifically, barometric pressure is sensed or estimated at the start of an engine operating cycle. An idle air control actuator speed is referenced as a function of the barometric pressure. The actuator speed may be referenced by applying the barometric pressure to a stored lookup table or to a stored function. The actuator speed represents the maximum time rate of change in actuator position under the current barometric pressure at which the idle air control actuator may be driven without subjecting the actuator to instabilities or to position inaccuracies. The relationship between the actuator speed and barometric pressure is determined through conventional calibration or test procedure in which the maximum stable time rate of change in actuator position is determined for each barometric pressure along a range of barometric pressures. For example, a commercially-available idle air control actuator may include manufacturer torque specifications, such as actuator output torque as a function of actuator speed. For a given barometric pressure, the maximum speed of the actuator may be selected in the calibration or test procedure as the speed associated with a specified actuator torque output that is slightly greater than the total torque load on the actuator (including the load imposed by the given barometric pressure). After selecting the actuator speed as a function of barometric pressure, the actuator is driven from a current position to a target position at a speed not exceeding the selected speed, so as to not violate stability limits of the actuator.

In accord with a further aspect of this invention, the referenced actuator speed is applied to adjust a frequency of a control loop which issues control commands of a fixed size to the idle air control actuator. In accord with yet a further aspect of this invention, the referenced actuator speed is applied to adjust the magnitude of the size of control commands applied to the idle air control actuator during control loops that occur at a fixed frequency. In accord with still a further aspect of this invention, the referenced actuator speed is applied to an actuator driver circuit which directly controls the time rate of change in actuator position between a current actuator position and a target position by directly controlling the level of motor coil energization.

BRIEF DESCRIPTION OF THE DRAWINGS

The invention may be best understood by reference to the preferred embodiment and to the drawings in which.

DESCRIPTION OF THE PREFERRED EMBODIMENT

Figure 1:
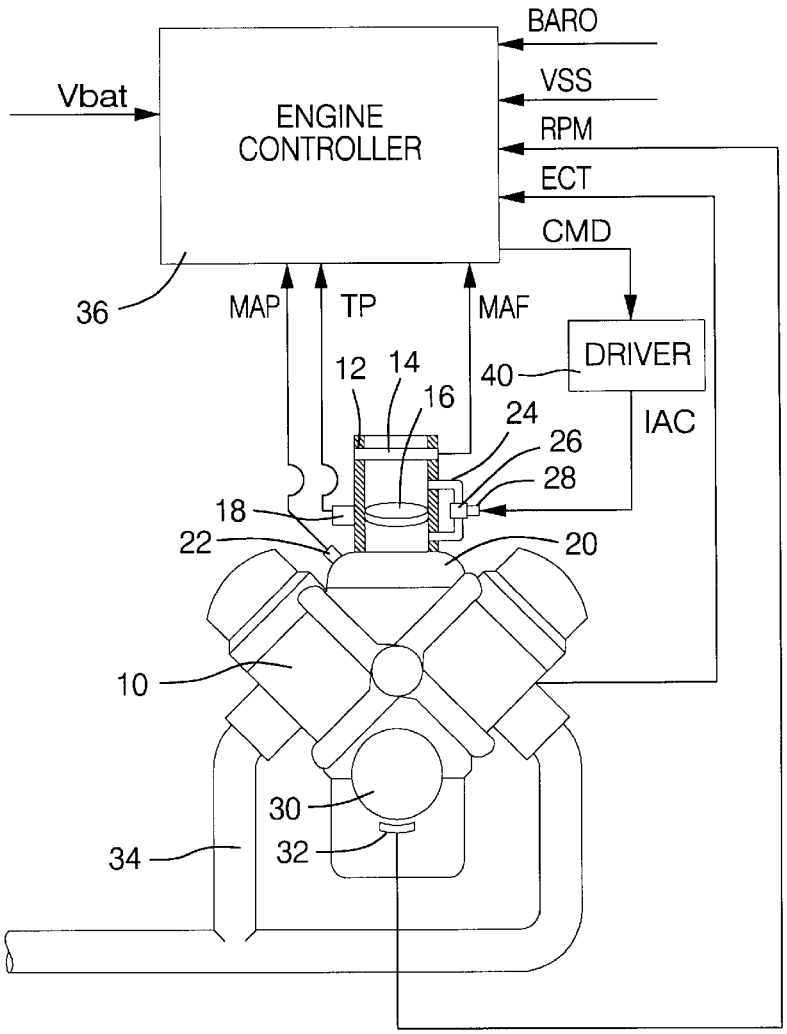
FIG. 1 is a general diagram of an engine and engine control hardware of the preferred embodiment of this invention.

Referring to FIG. 1, internal combustion engine 10 receives intake air through an intake bore 12 in which is rotatably positioned an intake air valve 16 of the rotary or butterfly type which is manually rotated within the bore 12 to vary restriction to intake air passing through the bore to an intake manifold 20. An airflow meter 14 of the thick film or hot wire type is positioned within the bore 12 for transducing the mass flow rate of air passing across the sensor into output signal MAF. A potentiometric position sensor 18 is mechanically linked to the intake air valve 16 to rotate therewith for transducing, in any suitable conventional manner, a degree of rotation of the valve 12 away from a rest position into an output signal TP. A conventional pressure transducer 22 is positioned within the intake manifold 20 for transducing absolute air pressure therein into output signal MAP. An estimate of barometric pressure in the operating environment of the engine 10 is transduced in any suitable conventional manner into representative signal BARO. For example, a dedicated, commercially-available barometric pressure sensor may be provided for transducing barometric pressure into signal BARO. Alternatively, a lower cost approach generates signal BARO by sampling signal MAP under operating conditions in which there is substantially no pressure drop across the intake air valve 16, such as during certain wide open throttle conditions when the intake air valve is at a fully open position, or such as prior to engine startup in which there is substantially no movement of air across the intake air valve 16.

Bypass passage 24 in the form of a closed conduit opens into the intake air bore 12 on its first end at a position upstream, according to the normal direction of airflow through the bore 12, of the intake air valve 16 and opens on a second end opposing the first end downstream, according to the normal direction of airflow through the bore 12, of the intake air valve. The bypass passage serves as an engine inlet air passage bypassing the intake air valve 16. A bypass valve 26 taking the form of an electronically controlled solenoid engine inlet air valve or any suitable conventional engine inlet air valve is positioned within the bypass passage 24 and is mechanically coupled, such as through a conventional geartrain, to an actuator 28 of the stepper motor type in this embodiment. The actuator 28 is electronically driven in response to a control signal IAC applied thereto in the form of a drive current, to vary the position of the bypass valve 26 within the bypass passage 24 and thereby vary restriction to airflow through the bypass passage during idle operating conditions as are understood in the art to which this invention pertains to include conditions of relatively low engine speed, such as below one thousand r.p.m., and intake air valve in its rest (maximum airflow restriction) position within the bore 12.

The intake air passing to the intake manifold is distributed to a plurality of engine cylinder intake runners (not shown) where it is combined with an injected quantity of fuel (not shown) forming an air-fuel mixture. The air-fuel mixture is selectively admitted to engine cylinders (not shown) for combustion therein. The combustion process drives pistons (not shown) within the cylinders in a reciprocal manner. The pistons are linked to an engine output shaft 30 such as a crankshaft to rotationally drive the crankshaft which is coupled to driven vehicle wheels (not shown) for driving a corresponding automotive vehicle (not shown).

A sensor 32 taking the form of a Hall effect, variable reluctance, or magnetoresistive sensor in this embodiment is secured to the engine 10 in a fixed position relative to the output shaft 30 in proximity to a plurality of spaced teeth or notches machined about the circumference of the output shaft 30. As the shaft rotates, the teeth or notches pass in proximity to the sensor 32 and disrupt a field, such as of the electromagnetic type, generated about the sensor. The field disruption measurably and predictably varies the impedance of the sensor 32 which appears as a variation in signal RPM. The teeth or notches about the circumference of the output shaft 30 are spaced such that the rate of rotation of the shaft 30 may be determined from the frequency of successive disruptions of the signal RPM, as is generally known in the art. Certain engine cylinder events may further be diagnosed from the character of the signal RPM, including cylinder top dead center events.

Exhaust gasses produced in the cylinder combustion process are guided out of the cylinders to catalytic treatment devices through exhaust passage 34. A temperature sensor, such as a conventional thermocouple or thermistor is positioned within an engine coolant circulation path (not shown) for transducing the temperature of the coolant, as an indication of engine temperature, into output signal ECT. An engine controller 36 includes such well-known elements (not shown) as a central processing unit, read only memory devices (ROM) for long term data storage and retrieval, random access memory devices (RAM) for temporary, rapid data storage and retrieval, and input/output devices (I/O) for managing receipt of such input signals as MAP, TP, ECT, RPM, BARO, and a signal Vbat indicating current battery voltage, and for transmitting output signal for providing control and diagnostics operations, including signals IAC for driving the actuator 28 and fuel and ignition driven signals for controlling the mass of fuel injected prior to each cylinder combustion event and cylinder ignition timing, respectively.

A series of operations implemented in the form of step by step software instructions stored in ROM of the controller 36 are periodically executed by the controller 36 to provide for such control and diagnostic operations as is generally understood in the art. Such operations include the operations illustrated in FIGS. 2 and 3. Generally, the operations of FIG. 2 provide for startup operations to be executed at the start of each engine cycle, and the operations of FIG. 3 provide for servicing of a control interrupt used to, among other functions, update and output the control command IAC of FIG. 1.

Figure 2:
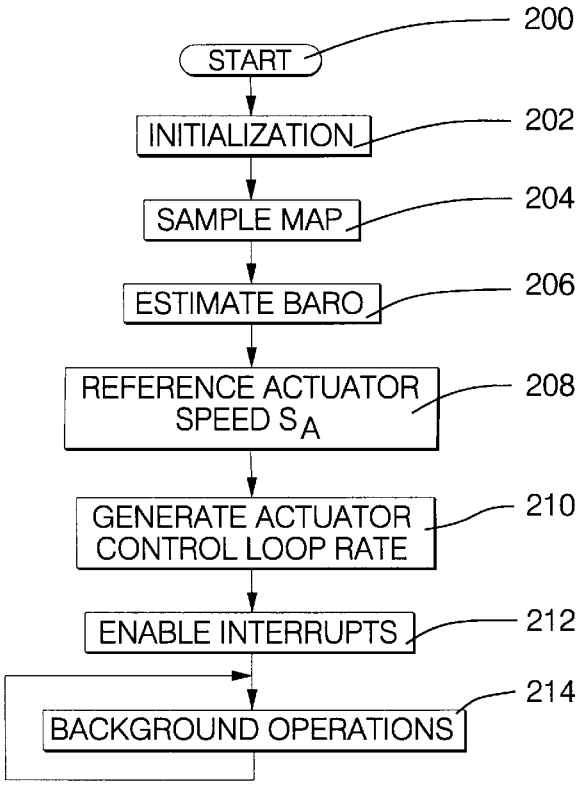
FIGS. 2–3 are flow diagrams illustrating a sequence of operations of the hardware of FIG. 1 for carrying out the engine control of the preferred embodiment.
Figure 3:
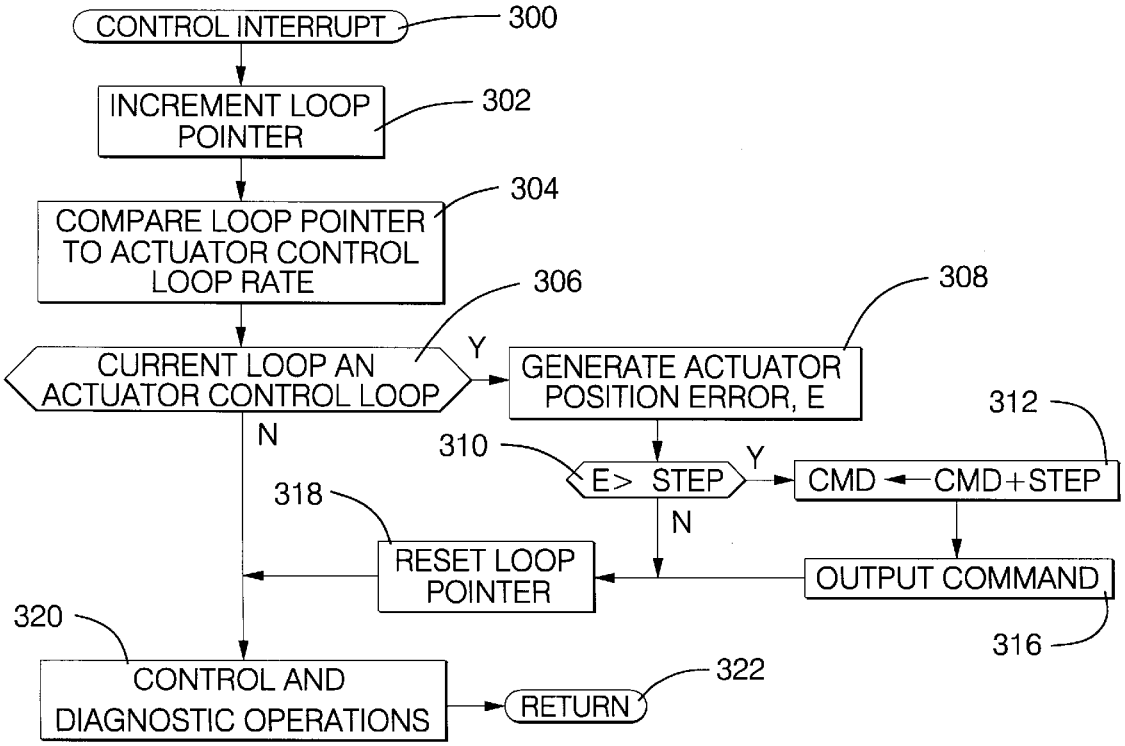

More specifically, the operations of FIG. 2 are initiated at a step 200 at the start of an engine operating cycle, such as when an engine operator rotates an ignition cylinder to its "on" position. The operations proceed from the step 200 to carry out general initialization operations at a next step 202. Such initialization operations include clearing RAM locations, transferring constants and pointers from ROM location to RAM locations, resetting flags, and any other standard initialization operations generally relied on in the art to which this invention pertains. Following initialization operations, the signal MAP of FIG. 1 is sampled at a step 204 as a current estimate of barometric pressure in the operating environment of the engine 10. MAP is sampled prior to engine cranking to ensure there is no pressure drop across the intake air valve so that the pressure in the intake manifold substantially corresponds to ambient barometric pressure. Accordingly, the MAP sample taken at step 204 is used at a next step 206 to estimate current barometric pressure BARO.

An actuator speed $S_A$ (also refered to herein as a time rate of change in actuator position) is next referenced at a step 208 as a function of the estimated BARO to adjust, in accordance with a critical aspect of this invention, the time rate of change in position of the bypass valve 26 so as to account for the effect of variation in barometric pressure away from a nominal barometric pressure on intake air density and on valve load. More specifically, under relatively low barometric pressure conditions, faster bypass valve transient response is required to compensate for a rapid change in operating conditions, as less change in mass air flow is yielded for a given change in valve position due to relatively low air density. The actuator speed $S_A$ provides for variation in a desired time rate of change in mass airflow rate into the engine intake manifold 20 of FIG. 1 as a function of BARO. Additionally, the torque load acting on the bypass valve is lower under relatively low barometric pressure conditions, allowing for more rapid movement of the valve without unacceptably reducing control stability. Accordingly, the actuator speed needed to provide the desired transient response is also subject to a speed limit set up as the maximum speed that can be provided without reducing valve position control stability below a calibrated stability threshold determined through a conventional calibration procedure. Position control stability requires sufficient actuator output torque to overcome the torque load on the valve, which includes a variable barometric pressure load. For conventional actuators, the available actuator output torque is inversely proportional to actuator speed. Accordingly, for a given barometric pressure, the speed determined at the step 208 is determined in such a manner that it will not exceed an actuator speed corresponding to the minimum actuator output torque needed to overcome the torque load on the valve plus a small torque offset to provide a stability margin, as is generally understood in the art.

Figure 4:
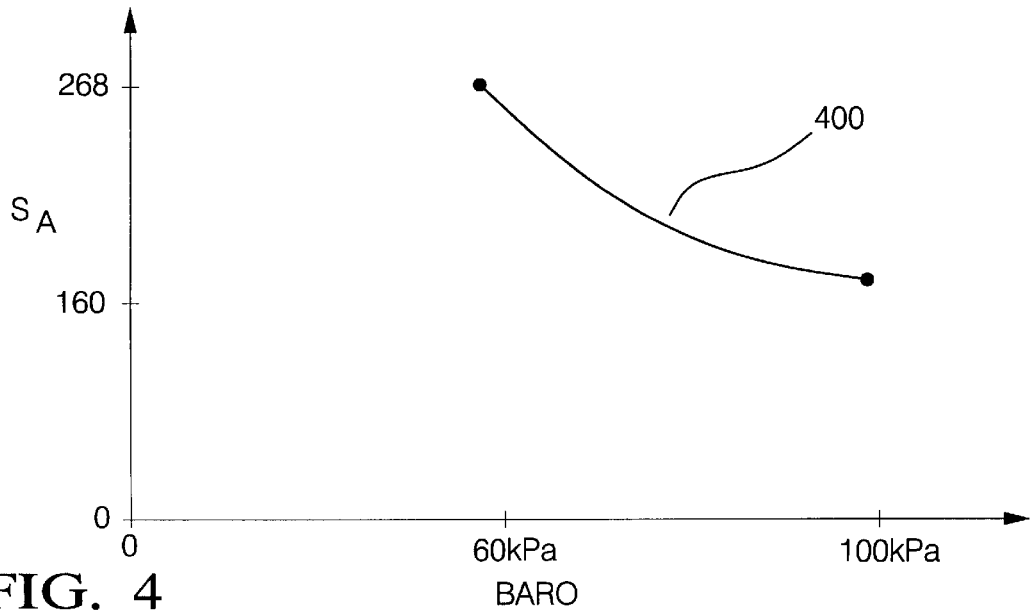
FIG. 4 is a graphical diagram of a parameter relationship used in the operations of FIG. 2.

The relationship between BARO and actuator speed SA is generated in this embodiment under the above considerations through a conventional calibration procedure. A representative calibrated relationship is illustrated by curve 400 of FIG. 4 in which $S_A$ is relatively high under low BARO conditions and decreases non-linearly with increasing BARO to account for increased load on the bypass valve and for increased air density which relieves the speed requirement, as described. The relationship between $S_A$ and BARO may be stored in ROM of the controller 36 in the form of a standard lookup table or may be stored in ROM in the form of a mathematical function to be executed each time step 208 is executed. For example, the function may take the following form:

$$S_A = S_N/(1-0.0101(100-\text{BARO}))$$

in which $S_N$ is a default actuator speed under certain predetermined nominal barometric pressure conditions.

Returning to FIG. 2, after determining $S_A$, an actuator control loop rate is determined at a next step 210 as the frequency at which the bypass valve actuator 28 (FIG. 1) position is to be updated to provide for the actuation speed $S_A$ determined at the step 208. More specifically, an actuator step size corresponding to about 0.08 millimeters of bypass actuator pintle movement is pre-established in accordance with a desired degree of bypass valve position control resolution. The actuator control loop rate is then determined as the rate at which the actuator position must be increased, in increments of the given step size, to provide for the rate of actuation dictated by $S_A$.

Following generation of the control loop rate, a plurality of interrupts are enabled at a next step 212 including standard time-based and event based interrupts. In an embodiment of this invention in which the engine controller 36 (FIG. 1) includes a number of time-based interrupts, each with a fixed interrupt rate, the time-based interrupt having an interrupt rate closest to the actuator control loop rate determined at the step 210 is enabled and is assigned the interrupt service operations illustrated in FIG. 3, to be described. Alternatively, a time-based interrupt is enabled at the step 212 if the actuator control loop rate is substantially a multiple of its interrupt rate. Alternatively, in an embodiment of this invention in which the engine controller 36 (FIG. 1) includes a number of time-based interrupts with interrupt rates that may be readily re-configured, a time-based interrupt is set up and enabled at the step 212 to repeatedly occur at the control loop rate established at the step 210, and to be serviced, upon each occurrence, by the operations of FIG. 3.

After enabling the interrupts at the step 212, background operations are repeatedly executed at a next step 214 including, standard maintenance and diagnostic operations of a relatively low priority so as to be temporarily suspended upon occurrence of any of the interrupts enabled at the step 212. More specifically, upon occurrence of the actuator control loop interrupt which, as described, is set up to occur periodically at a frequency consistent with the actuator control loop rate established at the step 210, the interrupt service operations of FIG. 3 are carried out, beginning at a step 300 and proceeding to increment a stored loop pointer at a next step 302. The loop pointer maintains a count of the number of iterations of the operations of FIG. 3 between each update of the actuator control command issued to the actuator 28 of FIG. 1. The loop pointer is next compared to the actuator control loop rate determined at the described step 210. The loop pointer must correspond to the number N of multiples of the interrupt rate of the interrupt that initiated the operations of FIG. 3 that substantially make up the actuator control loop rate before actuator control operations of steps 308–314 are executed. For example, if the interrupt rate of the time-based interrupt that initiates the operations of FIG. 3 is ten milliseconds and the generated actuator control loop rate is forty milliseconds, N equals 4 and the loop pointer must equal four before the control operations of steps 308–314 are carried out to provide for speed control of the actuator in accord with the principles of this invention.

Returning to FIG. 3, if, due to the comparison of the current value of the loop pointer with the actuator control loop rate at the step 304 indicates that the current iteration of the operations of FIG. 3 is an iteration in which actuator control operations are required, as determined at a next step 306, then the steps 308–314 are carried out to provide for actuator speed control. More specifically, an actuator position error E is generated at a step 308 as a difference between a desired bypass valve actuator position (also referred to herein as a target position of the bypass valve) determined through standard engine control operations and a current actual bypass valve position as indicated by the most recent commanded bypass valve position CMD. Alternatively, the current actual bypass valve position may be transduced by a conventional valve position sensor (not shown). The desired bypass valve actuator position is determined in this embodiment as a function of engine speed as indicated by signal RPM (FIG. 1) and manifold absolute pressure as indicated by signal MAP, as the position providing a needed degree of restriction to intake air passing through the conduit 24 of FIG. 1 (also referred to as an intake air passage) to provide a desired mass airflow rate into the intake manifold 20 (FIG. 1) to support a predetermined target engine speed. The desired bypass valve actuator position may be adjusted to account for a desired time rate of change in mass airflow into the engine intake manfold 20 of FIG. 1 to reject a detected time rate of change in torque load acting on the engine, such as may be indicated by a time rate of change in engine speed away from a set speed of about 650 r.p.m. under conventional idle operating conditions. The desired bypass valve actuator position may vary, in accord with the principles of this invention, with change in barometric pressure, as may be determined through a conventional calibration procedure, as the compensation for a time rate of change in torque load is dependent on the mass of air passing by the bypass valve, which is, as described, dependent on barometric pressure.

The error E is next compared to the pre-established step size STEP at a step 310. STEP is set to a bypass valve actuator command change equivalent to about 0.08 millimeters of bypass valve pintle travel, as described for the step 210 of FIG. 2. If the error E is determined to be greater than STEP at the step 310, the actuator command CMD is augmented by STEP at the step 312 and the updated command CMD is next output at a step 316 to the driver 40 of FIG. 1 for application as a corresponding drive current IAC to the actuator 28 to direct the actuator to move to a next position in direction toward the desired bypass valve actuator position. Generally, by repeatedly updating CMD in time-spaced increments of size STEP, a net actuator speed will be provided consistent with the speed $S_A$ determined at the step 208 and sufficient, in accord with the principles of this invention, to compensate for changing engine load under transient operating conditions, as described. Inherently then, as the speed $S_A$ determined at the described step 208 is limited to a maximum speed that preserves position control stability, the actuator command CMD will also be so limited in accord with the principles of this invention.

Returning to step 310, if the position error E is less than or equal to STEP, or following the step 316, the loop pointer is reset to zero at a next step 318 and next, or if the current loop is determined at the step 306 to not be an actuator control loop, general control and diagnostic operations are carried out at a step 320 including any conventional control or diagnostic operations required to be executed at the rate provided by the interrupt that initiated the operations of FIG. 3, as is generally understood in the art to which this invention pertains. Following the control and diagnostic operations of step 320, the interrupt service operations of FIG. 3 are concluded and the operations return, via a next step 322, to resume execution of any operations, such as the background operations of step 214, that were temporarily suspended to allow for servicing of the interrupt.

The inventors intend that the compensation for variation in barometric pressure as set forth in the preferred embodiment may be updated throughout an engine operating cycle in response to change in barometric pressure within the scope of this invention. For example, when conditions are determined to be present that allow for accurate estimation of barometric pressure, such as conditions under which the pressure drop across the intake air valve 16 of FIG. 1 is relatively low, the steps 204–210 of FIG. 2 may be carried out to estimate current barometric pressure and to adjust the actuator control loop rate in response thereto, in the manner previously described for FIG. 2.

The preferred embodiment is not intended to limit or restrict the invention since many modifications may be made through the exercise of ordinary skill in the art without departing from the scope of the invention.

The embodiments of the invention in which a property or privilege is claimed are described as follows:

1. A method for controlling time rate of change in position of an actuator coupled to an engine inlet air valve within an engine inlet air passage, comprising the steps of:

estimating barometric pressure;

generating a desired time rate of change in position of the actuator as a function of the estimated barometric pressure;

identifying a target position of the engine inlet air valve; and driving the actuator substantially at the desired time rate of change in position to move the engine inlet air valve toward the identified target position.

2. The method of claim 1, further comprising the step of:

generating a function describing a relationship between barometric pressure and substantially a maximum stable time rate of change in actuator position;

and wherein the step of generating a desired time rate of change in position of the engine inlet air valve generates the desired time rate of change in position by applying the estimated barometric pressure to the generated function.

3. The method of claim 1, wherein the generating step generates a desired time rate of change in position of the actuator as the maximum time rate of change in position at which the actuator may be driven under the estimated barometric pressure without reducing actuator stability below a predetermined stability threshold.

4. The method of claim 1, further comprising the steps of:

determining a current inlet air valve position;

calculating a difference between the current inlet air valve position and the target position as a position error;

generating an actuator command for driving the position error toward zero; and limiting the generated actuator command by the generated desired time rate of change in actuator position.

5. The method of claim 1, wherein the engine inlet air valve is an idle air control valve for varying restriction to engine intake air under idle operating conditions, the method further comprising the step of:

identifying when idle operating conditions are present;

and wherein the step of driving the actuator is carried out upon identifying that idle operating conditions are present.

6. A method for controlling mass flow rate of air entering an engine intake manifold through an engine intake air passage having an intake air valve therein, the intake air valve coupled to a controlled actuator, the method comprising the steps of:

estimating barometric pressure;

determining a desired time rate of change in position of the controlled actuator as a function of the estimated barometric pressure;

determining a desired position of the intake air valve corresponding to a desired degree of restriction to intake air passing through the engine intake air passage; and varying the position of the controlled actuator in accordance with the desired time rate of change in position to drive the intake air valve toward the desired position of the intake air valve.

7. The method of claim 6, further comprising the step of:

establishing a desired time rate of change of mass airflow rate into the intake manifold;

and wherein the step of determining a desired position of the intake air valve determines the desired position as the position providing for the desired time rate of change of mass airflow rate into the intake manifold.

8. The method of claim 7, wherein the step of determining a desired position of the intake air valve determines the desired position as a function of the estimated barometric pressure as the position providing for the desired time rate of change of mass airflow rate into the intake manifold.

9. The method of claim 6, wherein the determined time rate of change is a time rate of change limit, and wherein the varying step varies the position of the controlled actuator at a time rate of change limited by the time rate of change limit.

10. The method of claim 6, for controlling mass flow rate of air entering an engine intake manifold through an engine intake air passage during engine idle operating conditions, the intake air passage having an idle air control valve therein coupled to a controlled actuator, the method further comprising the step of:

identifying a presence of idle operating conditions;

and wherein the step of varying the position of the controlled actuator varies the position of the controlled actuator while idle operating conditions are identified as present.

* * * * *